US005383983A

United States Patent [19]

Kondo et al.

[11] Patent Number: 5,383,983

[45] Date of Patent: Jan. 24, 1995

[54] MARTENSITIC STAINLESS STEEL SUITABLE FOR USE IN OIL WELLS

[75] Inventors: Kunio Kondo, Kobe; Takahiro Kushida, Amagasaki; Masakatsu Ueda, Nara, all of Japan

[73] Assignee: Sumitomo Metal Industries, Ltd., Osaka, Japan

[21] Appl. No.: 45,596

[22] Filed: Apr. 9, 1993

[30] Foreign Application Priority Data

Apr. 9, 1992 [JP] Japan ..... 4-88506

[51] Int. Cl.[6] ..... C22C 38/44

[52] U.S. Cl. ..... 148/325; 420/68

[58] Field of Search ..... 148/325; 420/68

[56] References Cited

U.S. PATENT DOCUMENTS 2,795,519 6/1957 Angel et al. .
3,769,003 10/1973 Kenyon .
5,035,855 7/1991 Utsunomiya et al. .

FOREIGN PATENT DOCUMENTS 0386728 9/1990 European Pat. Off. .
0472305 2/1992 European Pat. Off. .
2550226 2/1985 France .
61-106747 5/1986 Japan .
61-207550 9/1986 Japan .
62-54063 3/1987 Japan .
2-243739 9/1990 Japan .
2-243740 9/1990 Japan .
3-2227 1/1991 Japan .
3-120337 5/1991 Japan .
3-60904 9/1991 Japan .
1221584 2/1971 United Kingdom .

*Primary Examiner*—Deborah Yee
*Attorney, Agent, or Firm*—Burns, Doane, Swecker & Mathis

[57] ABSTRACT

A martensitic stainless steel for use in oil wells has improved stability in strength and good resistance to sulfide stress corrosion cracking The steel has a chemical composition consisting essentially, on a weight basis, of: Si: not greater than 1.0%, Mn: not greater than 1.0%, Cr: 10.0–14.0%, Mo: 0.5–7.0%, Ni: 4.0–8.0%, Al: 0.001–0.1%, either Ti in an amount satisfying the following inequality (1) or Zr in an amount satisfying the following inequality (2), optionally one or both of Mg: 0.001–0.05% and Ce: 0.001–0.05%, and a balance of Fe and incidental impurities in which the contents of C, P, S, N, and V as impurities are limited to 0.05% or less, 0.04% or less, 0.005% or less, 0.05% or less, and 0.2% or less, respectively, the composition further satisfying the following inequalities (3) and (4):

$$4(\%C) \leqq \%Ti \leqq \{-0.01/(\%C+0.015))\}+0.75 \quad (1)$$

$$10(\%C) \leqq \%Zr \leqq 2\ 0\% \quad (2)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

20 Claims, 4 Drawing Sheets

MARTENSITIC STAINLESS STEEL SUITABLE FOR USE IN OIL WELLS

BACKGROUND OF THE INVENTION

The present invention relates to a martensitic stainless steel suitable for use in oil wells and gas wells (hereinafter collectively referred to as "oil wells"). More particularly, the invention pertains to a martensitic stainless steel for use in oil wells having excellent corrosion resistance sufficient to withstand severe corrosive environments which contain corrosive impurities such as carbon dioxide, hydrogen sulfide, and chloride ions while retaining a proper level of strength. The martensitic stainless steel is also useful in linepipe.

Recently, the environments in wells for collecting oil and natural gas have become increasingly severe. Not only are oil wells drilled deeper, but also the number of wells which contain carbon dioxide and/or hydrogen sulfide has increased. As a result, embrittlement of the materials used in oil wells due to corrosion or similar damage has become a serious problem.

Carbon steels and low alloy steels were used for many years to manufacture oil well tubing, which is one of the members generally used in oil wells. However, as the environments in oil wells become severer, the proportion of alloying elements added to steels for use in oil wells has been increased. For example, addition of Cr is known to improve the corrosion resistance of a steel in oil wells which contain carbon dioxide in a relatively high concentration, and Cr-containing steels such as 9%Cr-1%Mo steel and JIS SUS 420 martensitic stainless steel, which contain 9% and 13%, respectively, by weight of Cr, are frequently used in such oil wells.

However, such steels which contain a relatively large amount of Cr do not have good corrosion resistance to hydrogen sulfide. Therefore, the use of these steels in environments which contain hydrogen sulfide along with carbon dioxide is substantially limited since they are susceptible to sulfide stress corrosion cracking in such environments.

In such severe corrosive oil well environments containing both carbon dioxide and hydrogen sulfide, it is necessary at present to use a duplex stainless steel or austenitic stainless steel having a further high content of alloying elements. However, such a steel having an increased content of alloying elements significantly adds to the material costs.

Various attempts have been made to develop a relatively inexpensive steel for use in oil wells which is based on the above-described JIS SUS 420 martensitic stainless steel and which has improved corrosion resistance so as to withstand $H_2S$-containing severe corrosive environments.

Japanese Patent Publication No. 3-2227(1991) discloses a JIS SUS 420-based low-C steel having improved resistance to stress corrosion cracking in $H_2S$-containing environments. The steel contains 3.5–6% Ni and 0.5–3% Mo and has a decreased carbon content of 0.02% or less on a weight basis.

Japanese Unexamined Patent Applications Laid-Open Nos. 2-243740(1990) and 3-120337(1991) each disclose a steel JIS SUS 420 having good resistance to sulfide stress corrosion cracking, characterized by decreased Ni and Mo contents, and addition of one or more of Ti, Nb, V, and Zr or decreased Mn and S contents.

Japanese Unexamined Patent Applications Laid-Open Nos. 61-106747(1986) and 62-54063(1987) disclose a low-C, Ca-containing martensitic stainless steel in which Zr and Ti may be added.

Japanese Patent Publication No. 3-60904(1991) describes a martensitic stainless steel for seamless tubes which may contain one or more of various alloying elements including Ni, Mo, Cu, Nb, V, Ti, and Ca and which have limited S and P contents.

Japanese Unexamined Patent Application Laid-Open No. 61-207550(1986) discloses a boron-containing martensitic stainless steel suitable for use in acidic oil wells.

Japanese Unexamined Patent Application Laid-Open No. 2-243739(1990) discloses a martensitic stainless steel for use in oil wells which contains 15%–19% by weight of Cr.

It is known that a decrease in hardness or softening of a martensitic steel accompanied by a decrease in tensile strength is effective for reducing its susceptibility to sulfide stress corrosion cracking. Nickel-containing martensitic stainless steels as described in Japanese Patent Publication No. 3-2227 (1991) have an $Ac_1$ point which is much lower than that of the conventional JIS SUS 420 steel. Accordingly, there is a need for a Ni-containing martensitic stainless steel which can be readily softened by tempering at a low temperature which is below the decreased $Ac_1$ point.

The incorporation of additional alloying elements such as Ti, Nb, V, and/or Zr in a martensitic stainless steel as taught by Japanese Unexamined Patent Applications Laid-Open Nos. 2-43740(1990) and 3-120337(1991) serves to stabilize strength after tempering. However, upon further investigations, it was found that the resulting steel sometimes shows an abnormal fluctuation in strength, which is a problem in production of the steel on a commercial scale.

SUMMARY OF THE INVENTION

It is an object of the present invention to provide a martensitic stainless steel for use in oil wells capable of withstanding stress corrosion cracking in severe corrosive environments which contain carbon dioxide and hydrogen sulfide while retaining a proper level of strength.

A further object of the present invention is to provide such a martensitic stainless steel which can be satisfactorily produced on a commercial scale.

A more specific object of the present invention is to provide a martensitic stainless steel which can be readily softened by tempering at a relatively low temperature and which does not fluctuate in strength after tempering.

The present invention provides a martensitic stainless steel for use in oil wells having improved stability in strength and good resistance to sulfide stress corrosion cracking, which has a chemical composition consisting essentially, on a weight basis, of:

Si: not greater than 1.0%, Mn: not greater than 1.0%,

Cr: 10.0–14.0%, Mo: 0.5–7.0%,

Ni: 4.0–8.0%, Al: 0.001–0.1%, either Ti in an amount satisfying the following inequality (1) or Zr in an amount satisfying the following inequality (2), optionally one or both of Mg: 0.001–0.05% and Ce: 0.001–0.05%, and a balance of Fe and incidental impurities in which the contents of C, P, S, N, and V as impurities are limited to 0.05% or less, 0.04% or less, 0.005% or less, 0.05% or less, and 0.2% or less, respectively, the composition further satisfying the following inequalities (3) and (4):

$$4(\%C) \leqq \%Ti \leqq \{-0.01/(\%C+0.015)\}+0.75 \quad (1)$$

$$10(\%C) \leqq \%Zr \leqq 2.0\% \quad (2)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

DETAILED DESCRIPTION OF THE INVENTION

In the following description, all percents are by weight as long as a they are concerned with a steel chemical composition.

The present inventors investigated the effects of various elements on strength or hardness of low-C, Ni-Cr-Fe-based martensitic stainless steels and made the following discoveries.

Figure 1:
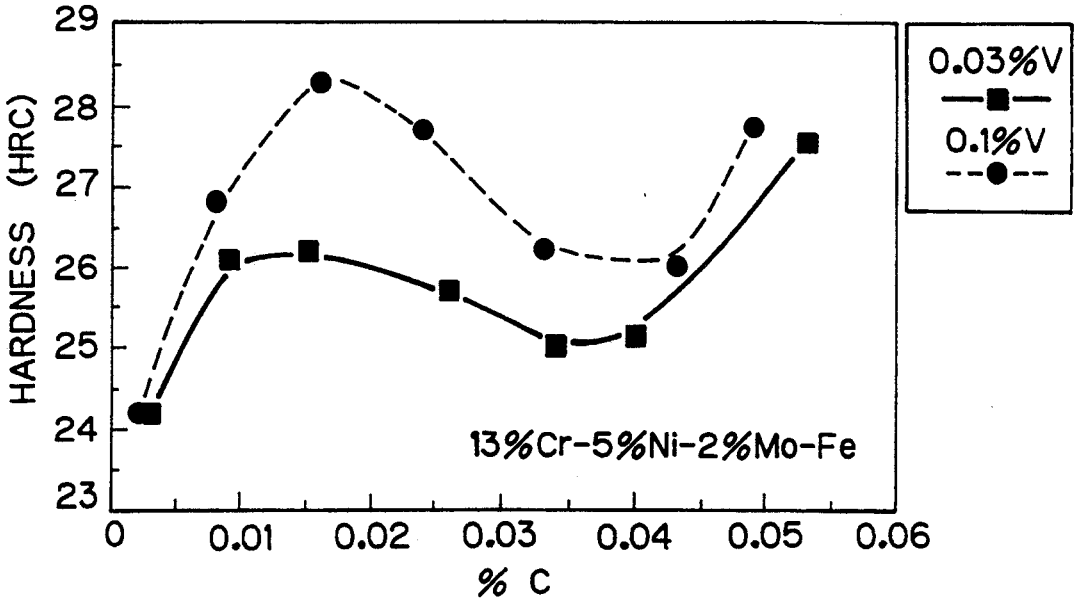
FIG. 1 shows the effect on hardness of C and V contents of low-C martensitic stainless steels.

(i) In the low-C martensitic stainless steels, a slight variation in the C content causes an abnormal fluctuation in hardness after tempering. FIG. 1 shows an example of such a fluctuation. The hardness after tempering initially increases to an abnormally high level as the C content is increased to a range of 0.01–0.03% and this behavior is enhanced by the presence of V in an increased amount. This fact indicates that the hardness varies greatly depending on a very slight fluctuation in the C content in such a low-C range and it is difficult to soften the steel by tempering in this range.

(ii) When the C content is outside the range of 0.01–0.03%, an abnormal increase in hardness can be avoided. However, a reduction of the C content to an extremely low-C range of 0.01% or less involves a considerable increase in refining costs, which is not acceptable from a commercial viewpoint. On the other hand, the presence of C in an amount of 0.03% or more leads to an undesirable decrease in corrosion resistance.

(iii) The abnormal hardening after tempering described in (i) above is caused by precipitation of fine chromium and vanadium carbides, which serve to increase the hardness of the steel. Furthermore, once formed, these precipitates are difficult to grow into coarser grains since the amount of carbon dissolved in the matrix as solid solution is limited. As a result, the steel undergoes little softening even by tempering for a prolonged period.

(iv) Addition of Ti or Zr to fix C in the form of carbides such as TiC or ZrC makes the matrix equivalent to extremely low-C steels and hence serves to minimize precipitation of Cr and V carbides. Consequently, the above-described abnormal fluctuation in hardness can be avoided and the steel can be significantly softened by tempering.

Figure 2:
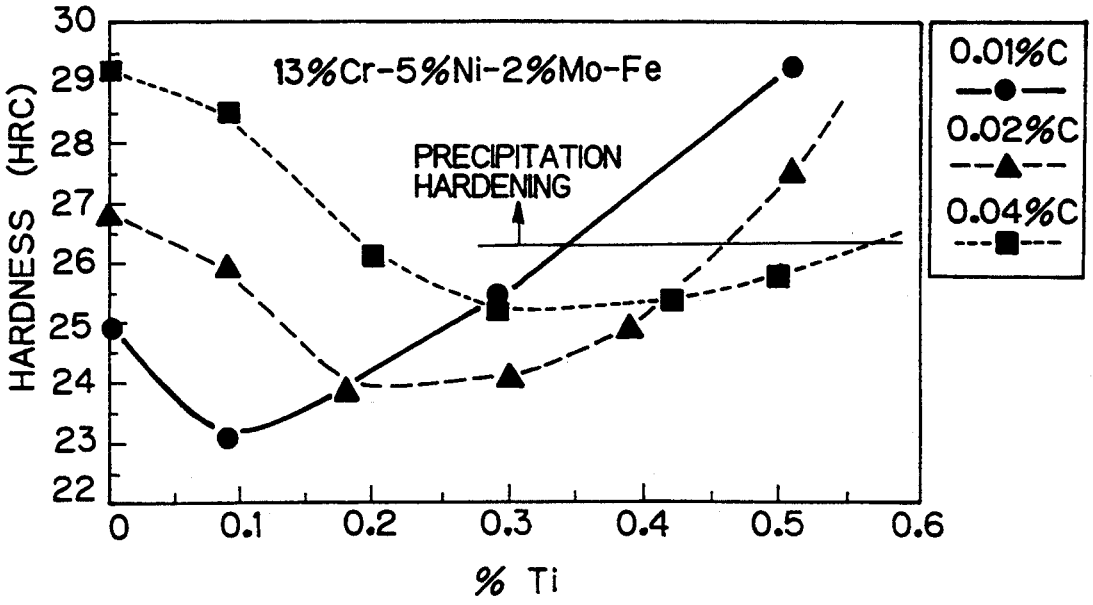
FIG. 2 shows the effect on hardness of C and Ti contents of low-C martensitic stainless steels.

(v) FIG. 2 shows the change in hardness after tempering of martensitic stainless steels similar to those shown in FIG. 1 having different C contents as a function of Ti content. The hardness after tempering decreases by addition of Ti. However, when the amount of Ti added is excessively large, the hardness undesirably increases due to precipitation of a Ti-Ni intermetallic compound. Thus, there is a proper range of Ti content to attain the desired softening by tempering.

Figure 3:
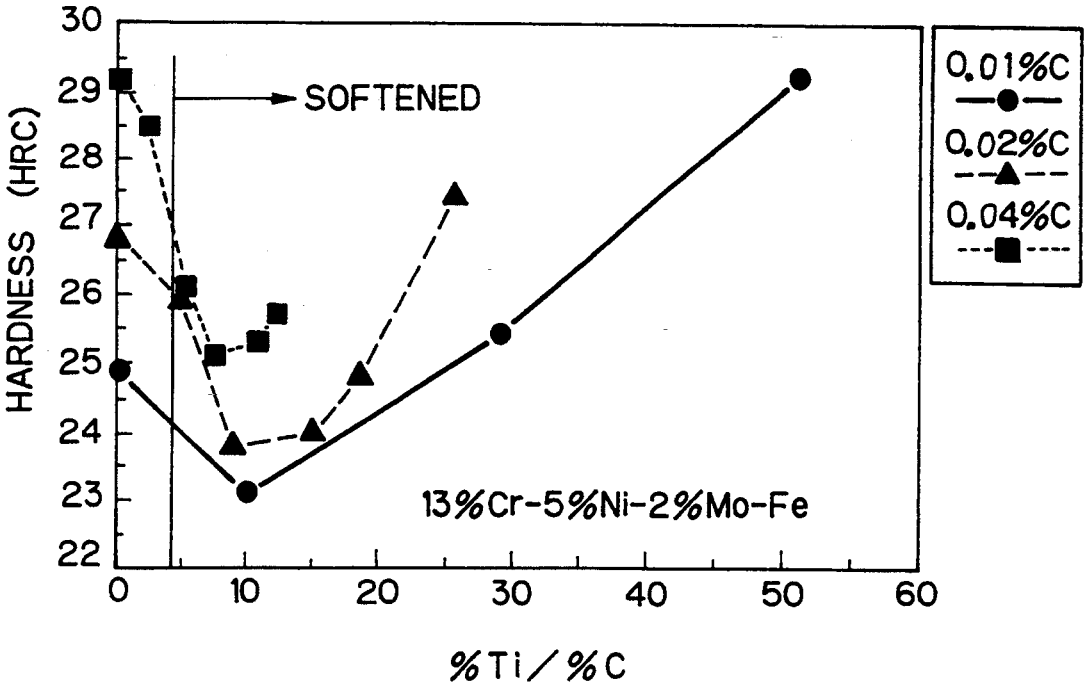
FIG. 3 shows the effect on hardness of C content and the value for %Ti/%C of low-C martensitic stainless steels.

FIG. 3 shows the results of FIG. 2 in terms of hardness as a function of the ratio of Ti content to C content (%Ti/%C). It can be deduced from this figure that the requisite condition for suppression of hardening attributable to precipitation of Cr and V carbides is $\%Ti/\%C \geqq 4$, i.e., $4(\%C) \leqq \%Ti$.

The region in which a Ti-Ni intermetallic compound is precipitated to harden the steel can be defined as a function of the C and Ti contents from the data shown in FIG. 2 and it varies depending on the C content. As shown in FIG. 3, the range of Ti content in which precipitation of a Ti-Ni intermetallic compound is suppressed can be defined in terms of a solubility-type formula as follows:

$$\%Ti \leqq \{-0.01/(\%C+0.015)\}+0.75.$$

Consequently, when Ti is added in an amount sufficient to satisfy the following inequality, the resulting steel can be readily softened by tempering, thereby ensuring that the hardness of the steel can be decreased in a stable manner:

$$4(\%C) \leqq \%Ti \leqq \{-0.01/(\%C+0.015)\}+0.75.$$

Figure 5:
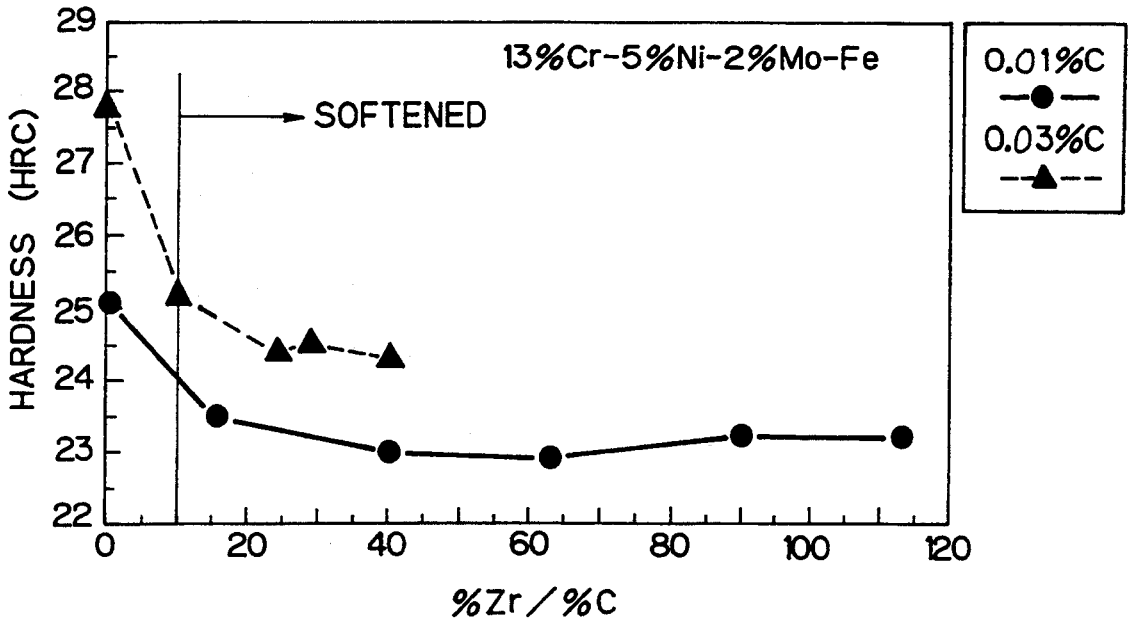
FIG. 5 shows the effect on hardness of C content and the value for %Zr/%C of low-C martensitic stainless steels.

(vi) FIG. 5 shows the change of hardness as a function of the ratio of Zr content to C content (%Zr/%C). Unlike Ti, Zr does not cause the steel to harden even if it is added in an excessive amount. Namely, when Zr is added in place of Ti, there is no need to take into account that the steel is hardened by precipitation of a Zr-Ni intermetallic compound since such a compound has a greater solubility. Therefore, softening can be achieved by tempering when Zr is added in an amount satisfying the inequality $\%Zr/\%C \geqq 10$ or $10(\%C) \leqq \%Zr$.

The present invention has been accomplished on the basis of the above-described findings. The reasons for the limits on each element in the chemical composition of the martensitic stainless steel according to the invention are described below. Si: Silicon is essential as a deoxidizer during refining of the steel. However, the presence of Si in excess of 1.0% decreases the toughness of the steel. Therefore, the Si content is not greater than 1.0% and preferably not greater than 0.75%.

Mn: Manganese is added as a deoxidizer, and it also serves to improve hot workability of the steel. Since addition of Mn in an excessively large amount tends to form austenitic phase, the Mn content is limited to not greater than 1.0%. When it is desired that the steel have improved resistance to pitting, it is desirable to limit the Mn content to at most 0.5% and preferably at most 0.3%. The lower the Mn content, the better the corrosion resistance caused by pitting.

Cr: At least 10.0% of chromium is necessary for forming a corrosion-resisting oxide film on the steel surface. However, addition of Cr in excess of 14.0% makes the steel uneconomical due to material costs. Furthermore, the presence of such a large amount of Cr along with Mo results in the formation of δ-ferrite, which decreases the corrosion resistance. Therefore, the maximum Cr content is limited to 14.0%. Preferably, the Cr content is between 11.0 and 13.5%.

Mo: Molybdenum is significantly effective for decreasing the susceptibility of a steel to sulfide stress corrosion cracking. Such an effect is not appreciable when the Mo content is less than 0.5%. However, addition of Mo in excess of 7.0% along with Cr tends to form δ-ferrite, thereby deteriorating the corrosion resistance. Therefore, the Mo content is in the range of 0.5–7.0%, preferably 1.0–4.0%, and more preferably 1.5–2.5%.

Ni: Nickel is added to maintain the desired steel structure of a single martensitic phase and assure that the steel has the required strength and corrosion resistance. These effects of Ni are not adequately attained when the Ni content is less than 4.0%. Addition of Ni in excess of 8.0% increases the amount of retained austenite, thereby deteriorating the corrosion resistance. Therefore, the Ni content is in the range of from 4.0 to 8.0%. Preferably it is from 4.0 to 6.0%.

Al: Aluminum is added as a deoxidizer. It is not effective for this purpose when the Al content is less than 0.001%. Addition of Al in excess of 0.1% results in the formation of a large amount of inclusions, which deteriorate the corrosion resistance. Therefore, the Al content is between 0.001 and 0.1% and preferably between 0.001 and 0.050%.

Ti: Ti is added to fix the carbon dissolved as a solid solution by preferentially forming its carbide (TIC), thereby preventing the carbon from forming fine precipitates of chromium carbide and vanadium carbide, which may cause abnormal hardening during tempering. Therefore, the Ti content should vary depending on the C content.

Figure 4:
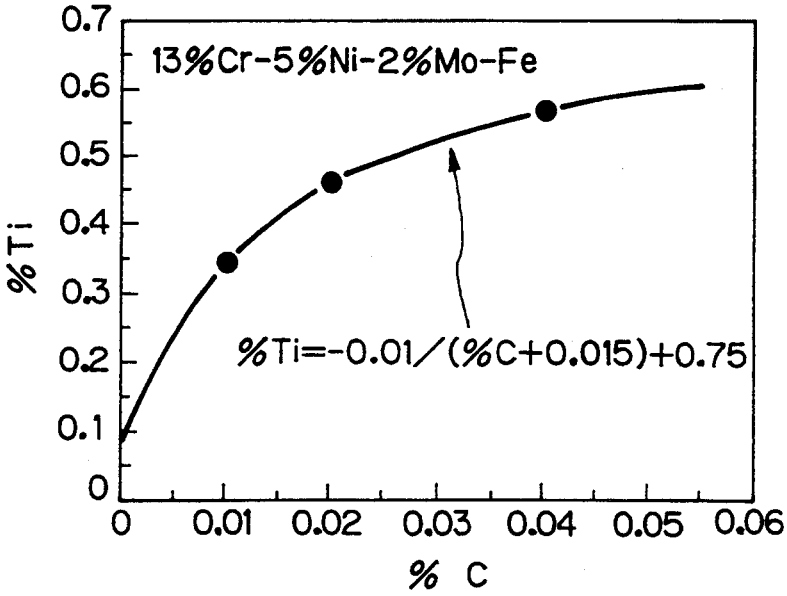
FIG. 4 shows the range of Ti content tolerable as a function of C content in order to obtain a stable hardness.

As discussed previously with reference to FIGS. 3 and 4, the minimum Ti content required to attain the above-described desired effect is $4\times(\%C)$. On the other hand, addition of Ti in an amount greater than the value of $[\{-0.01/(\%C+0.015)\}+0.75]$ results in the precipitation of a Ti-Ni intermetallic compound, which tends to increase the hardness. Thus, the Ti content is at least $4\times(\%C)$ and at most $[\{-0.01/(\%C+0.015)\}+0.75]$. Preferably the Ti content is at least $6\times(\%C)$ and most preferably it is approximately $10\times(C\%)$.

Zr: Zirconium serves to fix the dissolved carbon as ZrC and retard the formation of fine precipitates of Cr and V carbides, thereby preventing abnormal hardening of the steel. Therefore, when Zr is added in place of Ti, it is also necessary for the Zr content to vary depending on the C content.

As discussed previously with reference to FIG. 5, the minimum Zr content required to achieve the desired effect is $10\times(\%C)$. There is no particular upper limit on the Zr content from the standpoint of tensile strength, since addition of Zr in an excessive amount does not bring about precipitation hardening. However, when the Zr content is greater than 2.0%, the toughness and hot workability of the steel are degraded. Therefore, the Zr content is limited to at most 2.0%. Preferably, the Zr content is at least $15\times(\%C)$ and at most 1.0%.

When Ti and Zr are added together, the lower limits of the Ti and Zr contents are expressed by the following inequality (1–2) while the upper limits thereof are the same as defined by the above inequalities (1) and (2):

$$ti\ 4(\%C)\leqq\%Ti+(5/2)\%Zr \quad (1\text{–}2).$$

In such cases, therefore, the Ti and Zr contents should satisfy the following inequalities:

$$\%Ti\leqq\{-0.01/(\%C+0/.015)\}+0.75 \quad (1\text{–}1)$$

$$4(\%C)\leqq\%Ti+(5/2)\%Zr \quad (1\text{–}2)$$

$$\%Zr\leqq2.0\% \quad (2\text{–}1).$$

Mg and Ce: Magnesium and cerium are effective for improving the hot workability of the steel, and one or both of these elements may be added, if desired. When added, the contents of Mg and Ce are in the range of 0.001–0.05% each and preferably 0.001–0.010% each.

The chemical composition of the steel according to the present invention should satisfy the following inequalities (3) and (4).

$$30(\%Cr)+36(\%MO)+14(\%Si)-28(\%Ni)\leqq455 \quad (3)$$

$$21(\%Cr)+25(\%Mo)+17(\%Si)+35(\%Ni)\leqq731 \quad (4)$$

Since the steel is intended for use in oil wells, it is desired that it be a steel of a single martensitic phase so as to insure that the steel has a stable strength in a proper range and improved corrosion resistance. For this purpose, it is necessary to select a chemical composition such that the structure in the normal austenization temperature region of 800°–1100° C. is a single austenitic phase, without the formation of δ-ferrite at a higher temperature, so as to transform into martensite upon cooling. This requirement is met when inequality (3) is satisfied.

In order to form a steel of single martensitic phase which is free from retained austenite upon cooling to room temperature, the chemical composition must also satisfy inequality (4) at the same time.

In some cases, other phases such as carbides of Cr and V may be formed in minor proportions in the steel according to the present invention. However, the steel is not adversely affected by the formation of such carbides as long as either Ti or Zr is added in a proper amount depending on the C content and the chemical composition satisfy the above inequalities (3) and (4).

The balance of the steel consists essentially of Fe and incidental impurities. Among the impurities, each of C, P, S, N, and V has an upper limit, as described below.

C: A carbon content in excess of 0.05% results in an excessive increase in hardness after tempering as shown in FIG. 1, thereby undesirably increasing the susceptibility to sulfide stress corrosion cracking. At the same time, the amount of carbides precipitated is increased such that local corrosion tends to occur. Therefore, the upper limit of the C content is 0.05%. With views to decreasing the amount of Ti or Zr to be added and improving the corrosion resistance, it is desirable that the C content be reduced as much as possible. Preferably, the C content is at most 0.025%.

P: The upper limit of phosphorus content is 0.04% since a P content in excess of 0.04% significantly increases the susceptibility to sulfide stress corrosion cracking. Preferably, the P content is at most 0.02%.

S: It is desirable that the sulfur content be reduced as much as possible in order to maintain good hot workability. In view of the costs required for desulfurization, the upper limit of the S content is set at 0.005%. Preferably, the S content is at most 0.002%.

N: Nitrogen serves to increase the strength and it also increases the susceptibility to sulfide stress corrosion cracking. The presence of N in excess of 0.05% causes the steel to have an excessively increased strength and hence a significantly degraded corrosion resistance. Therefore, the upper limit of the N content is set at 0.05%. From the standpoint of improving the corrosion resistance, the N content should be reduced, and preferably it is at most 0.02%.

V: As shown in FIG. 1, even the presence of vanadium in an amount as small as 0.03% results in an abnormal, significant increase in hardness after tempering, particularly when the steel has a C content in the range of approximately 0.01–0.03%. Therefore, it is desirable that the V content be reduced as much as possible. However, since vanadium tends to be readily incorporated as a contaminant into starting materials used for melting, it is usually difficult to decrease the V content of a steel to 0.01% or less. As discussed above, the abnormal increase in hardness due to the incorporation of V can be avoided by adding Ti or Zr at a proper level. However, when the V content is over 0.2%, it is difficult to avoid the abnormal hardening even by addition of Ti or Zr. Therefore, the upper limit of the V content is set at 0.2%. Preferably, the V content is at most 0.1%.

The martensitic stainless steel according to the present invention can be prepared in a conventional manner, such as by melting a starting steel along with various alloying elements to form a molten steel having a desired chemical composition, casting the molten steel into an ingot, shaping the ingot into a desired shape by hot working, subjecting the steel to quenching for transformation into martensite, and finally subjecting it to tempering.

The martensitic stainless steel of the present invention can be readily softened by tempering. In consequence, the steel as quenched also has an adequately suppressed strength. Therefore, the corrosion resistance of the as-quenched steel is maintained at a satisfactory level which is sufficient for practical purposes as quenched. Accordingly, the steel may be used as quenched, or it may be subjected to heat treatment other than tempering prior to use.

Since the steel is martensitic, the strength of the steel can be controlled from low strength to high strength by varying the tempering temperature.

The following examples are presented to further illustrate the present invention. These examples are to be considered in all respects as illustrative and not restrictive.

EXAMPLE

Each of Steels A to R having the chemical compositions shown in Table 1 were prepared by casting a molten steel into an ingot and then shaping the ingot into an 8 mm-thick sheet by hot forging and hot rolling. Steels A to J are steels according to this invention, Steels K to M are conventional steels, and Steels N to R are comparative Steels. The sheet was quenched by heating for 30 minutes at 850° C. followed by water cooling and then tempered by heating for 30 minutes at 600° C. followed by air cooling. All the steels but Steels Q and R had a structure of a single martensitic phase. The values for the following formulas (3') and (4') are shown in Table2.

$$F=30(\%Cr)+36(\%Mo)+14(\%Si)-28(\%Ni) \quad (3')$$

$$M=21(\%Cr)+25(\%Mo)+17(\%Si)+35(\%Ni) \quad (4')$$

Each of the resulting tempered steels was tested for hardness and resistance to sulfide stress corrosion cracking by the following testing procedures. The test results are also shown in Table 2.

Hardness

Figure 6A:
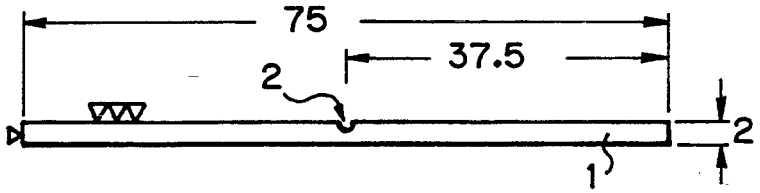
FIGS. 6(*a*), 6(*b*), and 6(*c*) show the shape of a test specimen used in a notched four-point bending test.
Figure 6B:
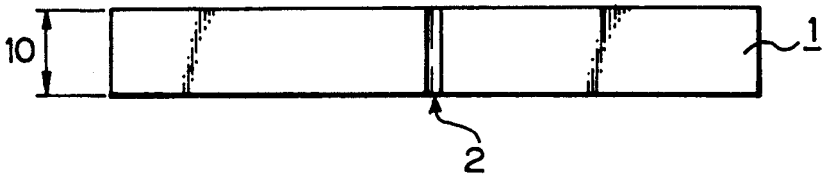
Figure 6C:
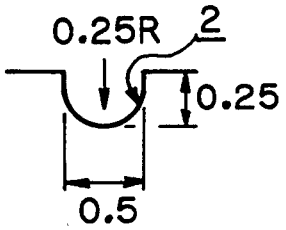

The hardness was evaluated in terms of Rockwell C-scale hardness (HRC) determined in accordance with JIS Z 2245. Resistance to sulfide stress corrosion cracking (SSCC):

The resistance to SSCC was evaluated by a corrosion test using test specimens for four-point bending having the shape shown in FIGS. 6(*a*), 6(*b*), and 6(*c*). Namely, each test specimen 1 measured 2 mm (t)×10 mm (w)×75 mm (1) and had a semi-circular notch 2 with 0.25R (0.25 mm in radius) extending along the shorter center line on one surface.

Figure 7A:
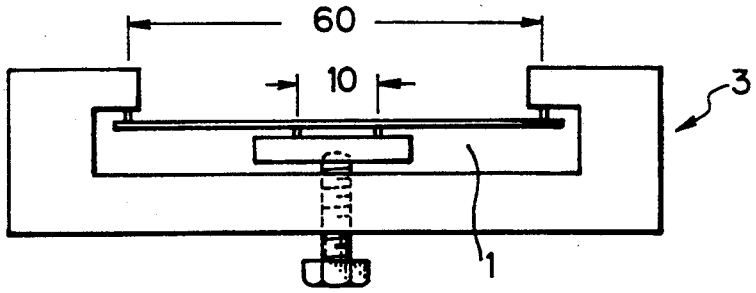
FIGS. 7(*a*) and 7(*b*) illustrate the manner of applying a stress to the test specimen shown in FIGS. 6(*a*) to 6(*c*) using a bending jig.
Figure 7B:
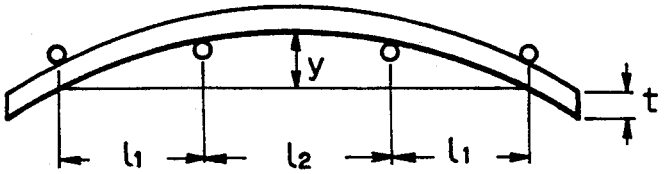

Two test specimens as described above were prepared for each steel and a bending stress was applied to each test specimen 1 using a bending jig 3 in the manner depicted in FIG. 7(*a*) such that the stress calculated by the following equation (5) equaled $1\sigma y$ ($\sigma y=0.2\%$ proof stress):

$$\sigma=E\times t\times y\times(2/3l_1^2=l_1l_2=\tfrac{1}{4}l_2^2)^{-1} \quad (5)$$

where E is Young's modulus and $l_1$, $l_2$, and t are the dimensions shown in FIG. 7(*b*) which illustrates the shape of the test specimen to which the bending stress was applied.

The two test specimens were immersed in a 5% NaCl solution in a severe corrosive atmosphere having partial pressures of 0.03 atm $H_2S$ and 30 atm $CO_2$ at 25° C. for 336 hours while a bending stress was applied to each test specimen in the above-described manner. Thereafter, each test specimen was removed from the solution and examined for cracking by visual observation of the appearance and observation of a cross-section under an optical microscope.

In Table 2, the marks "00" indicate that no cracking was observed on each test specimen, while the marks "XX" indicate that both test specimens were cracked.

As can be seen from Table 2, each of Steels A to J according to this invention showed a stable hardness and did not suffer sulfide stress corrosion cracking.

Conventional Steels K to M, which also contained Ti or Zr but in an amount outside the range defined herein, showed a significantly increased hardness due to precipitation of a Ti-Ni intermetallic compound or carbides and they suffered sulfide stress corrosion cracking.

Comparative Steels N to P, which had a V or C content outside the range defined herein or which did not contain Ti or Zr, had an excessively high hardness due to precipitation of fine carbides, and therefore stress corrosion cracking was observed in these steels. Each of Comparative Steels Q and R had a chemical composition which did not satisfy the foregoing inequality (3) or (4) so that they did not have a steel structure of single martensitic phase. As a result, the hardness of the steels was too low to maintain the strength at a level required for use in oil wells, although they did not suffer sulfide stress corrosion cracking.

TABLE 1

| | Steel | Chemical Composition (% by weight, Balance: Fe and Impurities) | | | | | | | | | | | | | |
|---|---|---|---|---|---|---|---|---|---|---|---|---|---|---|---|
| | | C | Si | Mn | P | S | Cr | Ni | Mo | Al | N | V | Ti | Zr | Others |
| This Invention | A | 0.015 | 0.28 | 0.65 | 0.02 | 0.001 | 13.0 | 5.5 | 2.1 | 0.008 | 0.003 | 0.09 | 0.26 | — | Mg: 0.0025 |
| | B | 0.019 | 0.37 | 0.25 | 0.01 | 0.002 | 13.3 | 5.4 | 2.0 | 0.020 | 0.004 | 0.10 | 0.20 | — | Ce: 0.0028 |
| | C | 0.021 | 0.06 | 0.26 | 0.02 | 0.001 | 12.2 | 5.6 | 1.9 | 0.001 | 0.005 | 0.07 | 0.34 | — | |
| | D | 0.016 | 0.31 | 0.28 | 0.02 | 0.001 | 11.8 | 5.3 | 2.1 | 0.020 | 0.002 | 0.05 | 0.31 | — | |
| | E | 0.032 | 0.33 | 0.36 | 0.02 | 0.001 | 12.1 | 5.8 | 2.0 | 0.009 | 0.001 | 0.10 | 0.35 | — | |
| | F | 0.020 | 0.71 | 0.45 | 0.02 | 0.001 | 11.9 | 5.6 | 2.2 | 0.002 | 0.003 | 0.07 | — | 0.45 | |
| | G | 0.018 | 0.23 | 0.52 | 0.01 | 0.002 | 11.8 | 6.8 | 3.5 | 0.025 | 0.006 | 0.05 | — | 0.53 | |
| | H | 0.029 | 0.36 | 0.81 | 0.01 | 0.001 | 13.5 | 5.9 | 1.2 | 0.002 | 0.004 | 0.10 | — | 0.67 | Mg: 0.0043 |
| | I | 0.043 | 0.08 | 0.33 | 0.02 | 0.001 | 12.2 | 5.3 | 2.2 | 0.007 | 0.004 | 0.11 | — | 1.70 | |
| | J | 0.011 | 0.36 | 0.21 | 0.02 | 0.002 | 10.6 | 4.0 | 3.5 | 0.013 | 0.005 | 0.09 | — | 0.40 | Mg: 0.0018 Ce: 0.0025 |
| Conventional | K | 0.010 | 0.45 | 0.61 | 0.01 | 0.001 | 13.1 | 5.0 | 1.9 | 0.012 | 0.002 | 0.18 | 0.48* | — | |
| | L | 0.013 | 0.46 | 0.55 | 0.02 | 0.001 | 12.9 | 4.9 | 2.0 | 0.011 | 0.003 | 0.14 | 0.03* | — | |
| | M | 0.032 | 0.43 | 0.60 | 0.02 | 0.001 | 12.9 | 5.1 | 2.0 | 0.018 | 0.003 | 0.15 | — | 0.13* | |
| Comparative | N | 0.082* | 0.35 | 0.43 | 0.01 | 0.002 | 13.1 | 5.0 | 1.8 | 0.012 | 0.004 | 0.07 | 0.35 | — | |
| | O | 0.023 | 0.35 | 0.45 | 0.02 | 0.001 | 12.9 | 4.9 | 1.9 | 0.009 | 0.005 | 0.25* | 0.32 | — | |
| | P | 0.016 | 0.37 | 0.41 | 0.01 | 0.002 | 12.8 | 5.0 | 2.2 | 0.010 | 0.003 | 0.15 | —* | —* | |
| | Q | 0.020 | 0.43 | 0.45 | 0.02 | 0.001 | 13.7 | 4.0 | 4.6 | 0.002 | 0.002 | 0.05 | 0.29 | — | |
| | R | 0.022 | 0.71 | 0.46 | 0.02 | 0.001 | 13.9 | 7.9 | 6.8 | 0.009 | 0.003 | 0.06 | — | 0.50 | |

Note: *Outside the range defined in the present invention.

TABLE 2

| | | F | M | Hardness (HRC) | Resistance to SSCC |
|---|---|---|---|---|---|
| Present Invention | A | 315.5 | 522.8 | 23.1 | ○○ |
| | B | 295.0 | 503.6 | 23.8 | ○○ |
| | C | 278.4 | 500.7 | 23.9 | ○○ |
| | D | 285.5 | 491.1 | 23.5 | ○○ |
| | E | 277.2 | 512.7 | 25.1 | ○○ |
| | F | 289.3 | 513.0 | 24.0 | ○○ |
| | G | 292.8 | 577.2 | 23.5 | ○○ |
| | H | 288.0 | 526.1 | 24.6 | ○○ |
| | I | 297.9 | 498.1 | 25.2 | ○○ |
| | J | 337.0 | 456.2 | 23.4 | ○○ |
| Conventional | K | 327.7 | 505.3 | 29.2 | xx |
| | L | 328.2 | 500.2 | 28.5 | xx |
| | M | 322.2 | 506.7 | 28.9 | xx |
| Comparative | N | 322.7 | 501.1 | 30.1 | xx |
| | O | 323.1 | 495.9 | 28.6 | xx |
| | P | 328.4 | 505.1 | 27.6 | xx |
| | Q | 470.6* | 550.0 | 13.5 | ○○ |
| | R | 450.5 | 750.5* | 18.9 | ○○ |

Note: F = 30(% Cr) + 36(% Mo) + 14(% Si) − 28(% Ni)
M = 21(% Cr) + 25(% Mo) + 17(% Si) + 35(% Ni)
*Outside the range defined in the present invention.

As discussed above, abnormal hardening encountered in conventional low-C, Cr-Ni-Fe martensitic stainless steels can be eliminated in the steel according to the present invention by limiting the V content and adding Ti or Zr in an amount which varies depending on the C content. As a result, fluctuations in hardness and strength are minimized to assure that the steel has the desired good corrosion resistance in severe corrosive environments containing $CO_2$ and $H_2S$. Therefore, the steel is quite suitable for use in oil wells as well as in oil well tubing and casing and other parts.

It will be appreciated by those skilled in the art that numerous variations and modifications may be made to the invention as described above with respect to specific embodiments without departing from the spirit or scope of the invention as broadly described.

What is claimed is:

1. A martensitic stainless steel for use in oil wells having improved stability in strength and good resistance to sulfide stress corrosion cracking, which has a chemical composition consisting essentially, on a weight basis, of:

Si: not greater than 1.0%, Mn: not greater than 1.0%, Cr: 10.0–14.0%, Mo: 0.5–7.0%, Ni: 4.0–8.0%, Al: 0.001–0.1%, either Ti in an amount satisfying the following inequality (1) or Zr in an amount satisfying the following inequality (2), one or both of Mg: 0–0.05% and Ce: 0–0.05%, and a balance of Fe and incidental impurities in which the contents of C, P, S, N, and V as impurities are limited to 0.05% or less, 0.04% or less, 0.005% or less, 0.05% or less, and 0.2% or less, respectively, said composition further satisfying the following inequalities (3) and (4):

$$4(\%C) \leqq \%Ti \leqq \{-0.01/(\%C+0.015)\}+0.75 \quad (1)$$

$$10(\%C) \leqq \%Zr \leqq 2.0\% \quad (2)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

2. The martensitic stainless steel according to claim 1, wherein the chemical composition consists essentially, on a weight basis, of:

Si: not greater than 1.0%, Mn: not greater than 1.0%, Cr: 10.0–14.0%, Mo: 0.5–7.0%, Ni: 4.0–8.0%, Al: 0,001–0.1%, either Ti in an amount satisfying the following inequality (1) or Zr in an amount satisfying the following inequality (2), and a balance of Fe and incidental impurities in which the contents of C, P, S, N, and V as impurities are limited to 0.05% or less, 0.04% or less, 0,005% or less, 0.05% or less, and 0.2% or less, respectively, said composition further satisfying the following inequalities (3) and (4):

$$4(\%C) \leqq \%Ti \leqq \{-0.01/(\%C+0.015)\}+0.75 \quad (1)$$

$$10(\%C) \leqq \%Zr \leqq 2.0\% \quad (2)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

3. The martensitic stainless steel according to claim 1, wherein the chemical composition consists essentially, on a weight basis, of:

Si: not greater than 1.0%, Mn: not greater than 1.0%,
Cr: 10.0–14.0%, Mo: 0.5–7.0%,
Ni: 4.0–8.0%, Al: 0,001–0.1%,
either Ti in an amount satisfying the following inequality (1) or Zr in an amount satisfying the following inequality (2),
one or both of Mg: 0,001–0.05% and Ce: 0,001–0.05%, and
a balance of Fe and incidental impurities in which the contents of C, P, S, N, and V as impurities are limited to 0.05% or less, 0.04% or less, 0,005% or less, 0.05% or less, and 0.2% or less, respectively,
said composition further satisfying the following inequalities (3) and (4):

$$4(\%C) \leqq \%Ti \leqq \{-0.01/(\%C+0.015)\}+0.75 \quad (1)$$

$$10(\%C) \leqq \%Zr \leqq 2.0\% \quad (2)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

4. A martensitic stainless steel for use in oil wells having improved stability in strength and good resistance to sulfide stress corrosion cracking, which has a chemical composition consisting essentially, on a weight basis, of:
Si: not greater than 1.0%, Mn: not greater than 1.0%,
Cr: 10.0–14.0%, Mo: 0.5–7.0%,
Ni: 4.0–8.0%, Al: 0.001–0.1%,
both Ti in an amount satisfying the following inequalities (1—1) and (1–2) and Zr in an amount satisfying the following inequalities (2–1) and (1–2),
one or both of Mg: 0–0.05% and Ce: 0–0.05%, and
a balance of Fe and incidental impurities in which the contents of C, P, S, N, and V as impurities are limited to 0.05% or less, 0.04% or less, 0.005% or less, 0.05% or less, and 0.2% or less, respectively,
said composition further satisfying the following inequalities (3) and (4):

$$\%Ti \leqq \{-0.01/(\%C+0.015)\}+0.75 \quad (1\text{–}1)$$

$$4(\%C) \leqq \%Ti+(5/2)\%Zr \quad (1\text{–}2)$$

$$Zr \leqq 2.0\% \quad (2\text{–}1)$$

$$30(\%Cr)+36(\%Mo)+14(\%Si)-28(\%Ni) \leqq 455 \quad (3)$$

$$21(\%Cr)+25(\%Mo)+17(\%Si)+35(\%Ni) \leqq 731 \quad (4).$$

5. The martensitic stainless steel according to claim 1, wherein the chemical composition contains 11–13.5% Cr, 1.5–2.5% Mo, and 4.0–6.0% Ni.

6. The martensitic stainless steel according to claim 2, wherein the chemical composition contains 11–13.5% Cr, 1.5–2.5% Mo, and 4.0–6.0% Ni.

7. The martensitic stainless steel according to claim 3, wherein the chemical composition contains 11–13.5% Cr, 1.5–2.5% Mo, and 4.0–6.0% Ni.

8. The martensitic stainless steel according to claim 4, wherein the chemical composition contains 11–13.5% Cr, 1.5–2.5% Mo, and 4.0–6.0% Ni.

9. The martensitic stainless steel according to claim 1, wherein the chemical Composition contains≦0.03% C and≦0.3% Mn.

10. The martensitic stainless steel according to claim 2, wherein the chemical composition contains≦0.03% C and≦0.3% Mn.

11. The martensitic stainless steel according to claim 3, wherein the chemical composition contains≦0.03% C and≦0.3% Mn.

12. The martensitic stainless steel according to claim 4, wherein the chemical composition contains≦0.03% C and≦0.3% Mn.

13. The martensitic stainless steel according to claim 5, wherein the chemical composition contains≦0.03% C and≦0.3% Mn.

14. The martensitic stainless steel according to claim 6, wherein the chemical composition contains≦0.03% C and≦0.3% Mn.

15. The martensitic stainless steel according to claim 7, wherein the chemical composition contains≦0.03% C and≦0.3% Mn.

16. The martensite stainless steel according to claim 8, wherein the chemical composition contains≦0.03% C and≦0.3% Mn.

17. The martensitic stainless steel according to claim 1, wherein the chemical composition contains≦0.03% Mn.

18. The martensitic stainless steel according to claim 2, wherein the chemical composition contains≦0.3% Mn.

19. The martensitic stainless steel according to claim 3, wherein the chemical composition contains≦0.3% Mn.

20. The martensitic stainless steel according to claim 4, wherein the chemical composition contains≦0.3% Mn.

* * * * *